United States Patent [19]

Poole et al.

[11] 4,010,600

[45] Mar. 8, 1977

[54] RETIPPED TOP-DRIVE FILLING SPINDLES

[75] Inventors: Ernest G. Poole, Charlotte; Lucius M. Hair, Pineville, both of N.C.

[73] Assignee: The Kendall Company, Boston, Mass.

[22] Filed: Apr. 16, 1975

[21] Appl. No.: 568,560

[52] U.S. Cl. ..... 57/129; 242/46.21; 242/118.3

[51] Int. Cl.[2] ..... B65H 54/54

[58] Field of Search ..... 57/129, 130, 135; 242/46.2, 46.21, 46.3–46.6, 118.3, 118.31, 118.32

[56] References Cited

UNITED STATES PATENTS

| | | | |
|---|---|---|---|
| 2,170,727 | 7/1937 | Mitchell | 57/129 X |
| 2,331,611 | 10/1943 | Kennedy et al. | 242/46.21 |
| 2,463,484 | 3/1949 | Gelpke | 57/129 |
| 2,582,325 | 1/1952 | Gleitz et al. | 57/130 |
| 2,781,629 | 2/1957 | Winslow | 57/135 |
| 3,534,917 | 10/1970 | Blake | 57/130 X |
| 3,878,997 | 4/1975 | Adams et al. | 57/130 X |

*Primary Examiner*—Donald E. Watkins
*Attorney, Agent, or Firm*—Edward J. Scahill, Jr.

[57] ABSTRACT

A top-drive filling spindle for use in the manufacture of textile yarn is provided wherein the tapered tip thereof is of a through hardened steel material that would more readily resist wear caused by the driving action of the quill disposed thereon. A top-drive filling spindle having wear on the tapered tip thereof can advantageously be retipped by grinding the worn tip to a predetermined size; applying a sleeve of through hardened steel or the like thereover; securing the sleeve thereon; and, finally grinding the thusly secured sleeve to the standard taper for top-drive filling spindles. With the application of the through hardened sleeve, it is anticipated that spindle wear would not occur for perhaps six to twelve years or more — a two to three fold increase over the life of spindles currently used by those skilled in the art.

6 Claims, 6 Drawing Figures

RETIPPED TOP-DRIVE FILLING SPINDLES

BACKGROUND OF THE INVENTION

Since before the turn of the century, the use of a spinning frame or twister in the manufacture of textile yarn, both cotton and manmade, has been widespread. A vital part of the spinning frame is known as the spindle which consists of a steel blade and bolster. A quill or bobbin has been an essential companion to the spindle since the invention of the spinning wheel, and the method of mounting the quill on the spindle has always presented a problem.

Prior to the advent of top-drive filling spindles, an acorn type or "bottom-drive" filling spindle was widely used. In this case, the quill, normally made of wood or the like, was applied to the revolving spindle to wind the textile yarn onto the quill after twist has been imparted thereto by the spinning frame, spinning ring and traveler. With the use of the acorn type of spindles, the speeds attainable therewith were somewhat limited due to gyration of the quill on the spindle. These gyrations further caused inconsistencies and imperfections to appear in the woven fabrics.

Accordingly, those skilled in the art turned to top-drive filling spindles with increasing frequency. In designing the spindle, provisions were made for this spindle to carry its full load without vibration or gyration. With the use of top-drive filling spindles, the drive point between the spindle and quill was moved from directly above the acorn of the spindle to the tapered tip of the spindle. The tip is tapered at the top to fit the internal bore of the quill, the contact between the spindle and quill at this point providing the sole driving of the quill. By utilizing this mode of driving the quill, it tends to find its own center of rotation, the gyration or vibration is greatly reduced, and, as a result, much higher spindle speeds are possible to achieve and are actually accomplished.

Although the spindle is induction hardened steel, wear still occurs on the spindle tapered tip after three or four years. Thus, slippage between the spindle and quill occurs, thereby causing less than calculated twist in the yarn being spun. It therefore becomes necessary to rework the taper of the spindle, so as to restore the original dimensions to the tapered spindle tip and consequently obtain additional use therefrom. In the past, this reworking has consisted of two basic methods: (a) a rehardening of the spindle tip and subsequent regrinding of the taper; and, (b) cutting the old tip off and subsequently butt welding a new tip on, rehardening, and then grinding to the desired taper. Both of these methods have advantages and disadvantages. In the simple rehardening process (a), the obvious advantage is cost and, normally, less manufacturing time, while the big disadvantage is that the regrinding process removes metal from the spindle tip, thereby causing the quill to drop and give less clearance at the acorn (bottom) of the spindle. This clearance is, of course, critical and if the grinding is not carried out with extreme accuracy, the result will be an acorn driven quill that results in much gyration and vibration. The advantage of the butt welding method (b) is that the disadvantage of the rehardening process is eliminated, as a new spindle specification is restored. However, the disadvantage of this method is cost, usually more manufacturing time and a relatively high percentage of butt weld failures. Additional disadvantages of both methods is the normal use therein of induction type hardening of the tips. Induction hardening of steel results in layers of hardening, with each successive layer from the outer case or surface producing a lower degree of hardness. In the actual use of a spindle tip hardened by these methods therefore, wear is greatly accelerated once the outer hardness becomes worn away. As a result, spindle tips produced thereby have a relatively short useful life span.

Accordingly, an object of this invention is to provide a top-drive filling spindle that will be capable of being used two to three times as long as prior art spindles.

Another object of the present invention is to provide an economic, efficient and reliable method of retipping worn top-drive filling spindles.

Still another object of the instant invention is to provide a top-drive filling spindle having a tapered tip portion that can be successfully retipped an indefinite number of times with ease, speed and low cost.

SUMMARY OF THE INVENTION

The uppermost, tapered tip portion of a top-drive filling spindle comprises a neck portion thereon of reduced diameter that is covered by a sleeve of a uniformly or through hardened material securely disposed thereon. The sleeve is ground to a predetermined taper prior to use with a quill in the manufacture of textile yarns. A thusly constructed top-drive filling spindle and the method of making same can be used on not only existing worn spindle blades, but also on new spindle blades as presented by a spindle manufacturer. By applying the sleeve of uniformly hardened material to new spindles, the thusly treated spindle blade is automatically ready to accept a new tip or sleeve, should the existing one become worn out. However, these spindle tips should have a life expectancy of between six and twelve years or more, and, if and when, wear does occur, it will be gradual wear rather than accelerated wear.

DETAILED DESCRIPTION OF THE PREFERRED EMBODIMENTS

Top-drive filling spindles have for years been made from a steel with a high carbon content that can be heated by an induction coil and rapidly quenched. This process produces a spindle blade that has a hard outer surface, but leaves the inner core relatively soft and ductile. Thus, spindles prepared in this manner have both ends very hard and a center portion that is left soft enough so that the spindle shaft can be straightened. However, this long used method of making spindles produces a blade that can be rather unpredictable as regards the degree and depth of hardness therein. Accordingly, once wear starts on the spindle at the point where it engages the quill, it proceeds at an extremely accelerated rate due to this soft inner core, so that the life expectancy of a new spindle is only about three to four years.

It has now been discovered that top-drive filling spindles made as outlined above can be given a life expectancy of six to twelve years or more by grinding down the uppermost tapered tip portion of the spindle to a predetermined diameter, and covering the thusly ground spindle tip with a sleeve of material possessing a high degree of hardness throughout. This newly formed tip is then retooled so as to produce a particular standard taper on the spindle.

Figure 1:
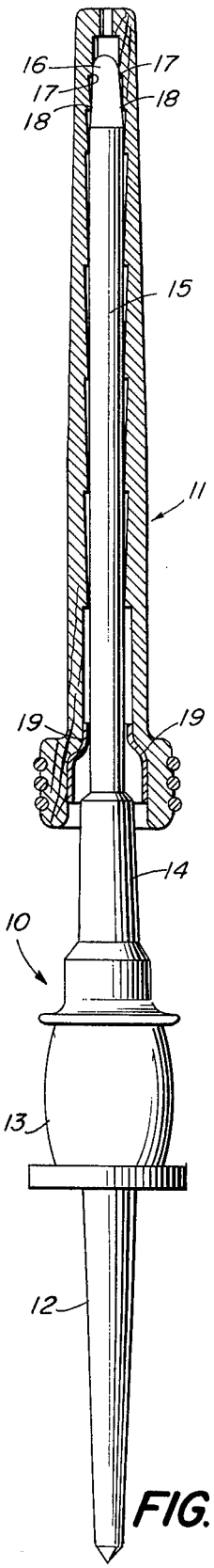
FIG. 1 shows a perspective view of a top-drive filling spindle having a typical quill disposed thereon.
Figure 3:
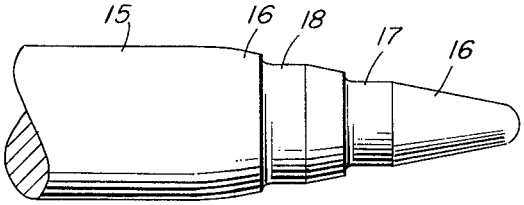
FIG. 3 shows an enlarged view of the spindle tip as described in this invention and having worn areas or rings thereon.

This operation can be more readily described by reference to the drawings wherein FIG. 1 shows a top-drive filling spindle 10 having a quill 11 disposed thereon. The spindle 10 comprises a spindle base 12, a whorl 13, and acorn taper at 14 and a spindle blade 15 which has a predetermined taper at the uppermost tip portion 16. The tapered tip 16 engages the quill 11 at points 17 and 18 thereon. Thus, the quill 11 is permitted to spin and perform the function that it was designed to perform. However, wear occurs at areas 17 and 18 thereon after repeated use and causes the quill 11 to drop on the spindle and to gyrate and vibrate thereon. In some cases this drop is so great as to cause the driving action to occur at the acorn taper 14 of the spindle 10 wherein the quill bushing 19 engages the acorn taper 14. FIG. 3 shows an enlarged view of the tapered tip portion of the spindle blade wherein wear areas or points 17 and 18 are shown in a somewhat exaggerated condition.

Figure 2:
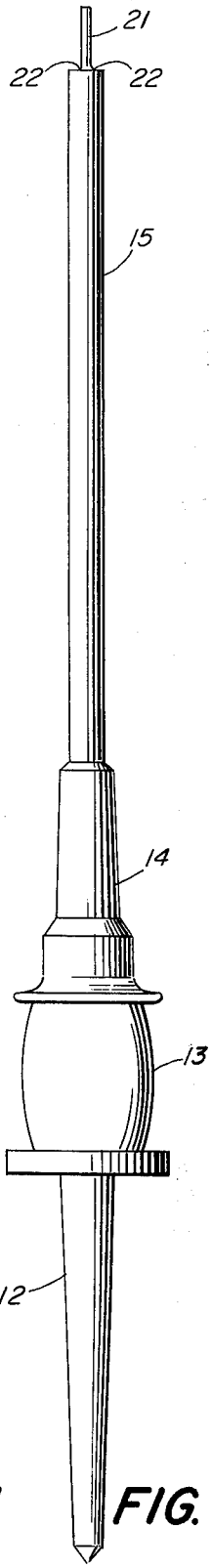
FIG. 2 shows a perspective view of a top-drive filling spindle having a ground neck or tip portion.

FIG. 2 shows the spindle 10, after the wear areas have been removed therefrom by plunge grinding the tapered tip portion so as to form a neck portion 21 of reduced diameter. The neck portion is ground so as to form a graduated pair of shoulder-like configurations 22 that facilitate the retipping process as will be described in more detail hereinafter.

Figure 4:
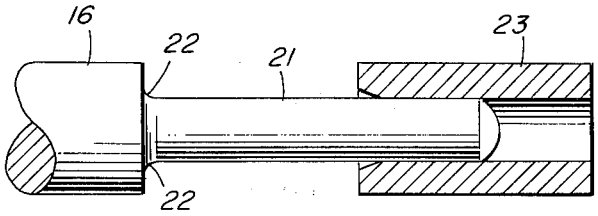
FIG. 4 shows an enlarged view of the ground tip or neck portion of the spindle of this invention and the sleeve of hardened material.

FIG. 4 shows the neck portion 21 in enlarged detail so as to better show the shoulder-like configuration at 22. A sleeve 23 of hardened material having an opening through the middle thereof which is approximately the same diameter as the neck portion 21, but of slightly less diameter than the shouldered portion at 22. The sleeve of hardened material 23 can advantageously be pressed over the neck portion 21 and secured thereto by exerting sufficient force on the sleeve as to cause the securement of the sleeve 23 onto the neck portion 21. Ordinarily, this press fit is of sufficient strength as to securely hold the sleeve in working contact with the spindle on the neck portion 21. However, some sort of adhesive or the like could be used to insure a stronger bond between the spindle and the sleeve, for example, the ground neck portion 21 can be dipped into Loctite 242, a tradename for an anaerobic sealant manufactured by Loctite Corporation of Newington, Connecticut. Of course, other similar adhesives and bonding materials could be used with similar results.

Figure 5:
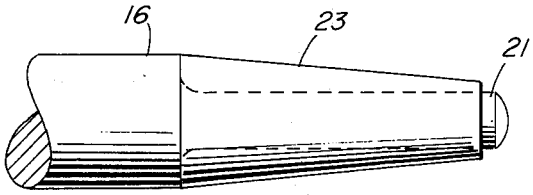
FIG. 5 shows an enlarged view of the spindle tip described herein having the hardened sleeve secured thereon and ground to a predetermined taper; and, FIG. 6 shows an enlarged view of another embodiment of the spindle of this invention.

Once the sleeve 23 is securely positioned in butting relationship with the spindle blade 16, the sleeve of hardened material may then be ground to a predetermined and standard taper for top-drive filling spindles. This can be shown in FIG. 5 wherein the sleeve 23 has been ground to the original taper specification of a new top-drive filling spindle. The sleeve of hardened material 23 is advantageously a through hardened steel, having uniform hardness throughout, so that if contact occurs between the tip and the quill at points 17 and 18, wear will occur very gradually and over a very long period of time. This is contrasted with standard prior art top-drive filling spindles which have a relatively soft inner core wherein, once the hard outer case wears away a rapid and accelerated wear occurs on the spindle tip within a very short period of time causing vibration and gyrations to occur when the quill is driven on the spindle blade. However, although through hardened steel is preferred as the sleeve material of this invention, other uniformly hardened materials can be used with similar, although possible somewhat less desirable, results. Such other materials would include ceramic or glass bits and carbide materials or the like. By through hardened steel is meant a furnace fired steel which is produced in such a manner as to harden the steel material uniformly throughout the body thereof.

This invention can be further explained by way of the following examples.

EXAMPLE I

A worn top-drive filling spindle having worn areas or points on the uppermost and tapered portion thereof as shown in FIG. 3 at 17 and 18, can effectively be renewed or restored by machine grinding at 450° locating center on the spindle as shown at 21 of FIG. 4. This, of course, can be achieved by holding the spindle approximately one inch below the tip in a steady rest and driving the spindle by the point end. Then the spindle is mounted in a machine grinder "between centers" using the point end of the spindle and the pointed 45° end made above. The worn taper can then be cylindrically ground away until the general shape shown in FIG. 4 is achieved with tip 21 ground to about 0.199 to 0.200 of an inch outside diameter by five-eighths of an inch long, with a 1/32 inch corner radius as shown at 22.

The cylindrically shaped sleeve of hardened material can be made from three-eighth inch diameter bar-type oil hardened tool steel, cold finished and annealed. All of the machining operations can be performed on an automatic screw machine lathe that has been previously tooled up and adjusted to make parts described as follows, wherein the outside diameter of the sleeve is rough turned to a taper having an upper portion of about 0.238inch in diameter and a lower tapered portion of about 0.318 inch in diameter. The sleeve is made to measure about 9/16 inch, the inside diameter is 0.197 – 0.198 in. and has the lower end chamfered ¼ inch diameter by 60°. The steel sleeve used herein was hardened and tempered to give a hardness of Rockwell C 58-60.

The sleeve is then press fit onto the newly ground spindle tip, and may be further secured thereto by means of a liquid sealant/adhesive compound or the like. Finally, the thusly worked spindle tip is ground to a taper of 0.150 inch per inch on the outside thereof. The spindle is then checked for true alignment and is straightened if required.

Figure 6:
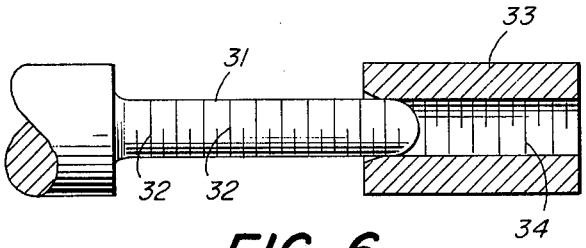

Another embodiment of this invention is shown in FIG. 6 wherein the ground neck portion 31 has threads 32 formed thereon, and the sleeve or hardened material 33 is made with a threaded inner core such as at 34. A spindle manufactured or retipped in this manner can facilitate replacement greatly because a worn tapered tip can then be simply unscrewed and removed while a new sleeve of hardened material can then replace it by simply screwing on to the neck portion 31. The thusly positioned sleeve can then be ground to a predetermined taper as described above and can be ready for subsequent use within a very short time after removal from the spinning frame. Of course, a lock-type sealant/adhesive can also be used therewith to insure a strong bond between the sleeve and the threaded spindle blade.

Top-drive filling spindles of this construction have extended the life of spindles by nearly two to three times what is normally now expected. Accordingly, those skilled in the art can now use and reuse spindles for an indefinite period of time, at a very low cost and with a minimum of down time. Furthermore, spindles utilizing the hardened tip portion described herein have a greatly reduced incidence of gyration and vibration, since the wearing on the spindle tip is a very gradual process.

The above described specific embodiments of this invention have been set forth for the purpose of illustration. It will become apparent to those skilled in the art that various modifications may be made in the structure of this top-drive filling spindle tip without departing from the principles of this invention as pointed out and disclosed herein. For that reason, it is not intended that the invention should be limited other than by the scope of the appended claims.

What is claimed is:

1. In a top-drive filling spindle having a spindle base, a whorl and an acorn taper, the improvements comprising a spindle blade of steel having a hard outer case and a ductile inner core with a neck portion of reduced diameter at the uppermost portion of said spindle blade; and, a tapered tip portion of uniformly hardened material secured over said neck portion in butting relationship with said spindle blade.

2. The spindle of claim 1 wherein said tip portion of hardened material is a through hardened steel sleeve.

3. The spindle of claim 1 wherein said tip portion of hardened material is a carbide sleeve material.

4. The spindle of claim 1 wherein said tip portion of hardened material is a ceramic sleeve material.

5. The spindle of claim 1 including a sealant securing said tip portion of hardened material to said neck portion of said spindle.

6. The spindle of claim 1 wherein said neck portion and said sleeve of hardened material are threaded and secured together by means of said threaded structure.

* * * * *